United States Patent [19]

Bancroft

[11] Patent Number: 4,825,595

[45] Date of Patent: May 2, 1989

[54] VENT GUIDE

[76] Inventor: Joseph C. Bancroft, 812 Sweetwater Blvd., Longwood, Fla. 32779

[21] Appl. No.: 39,385

[22] Filed: Apr. 17, 1987

[51] Int. Cl.[4] ..... E05D 13/00

[52] U.S. Cl. ..... 49/419; 49/421; 49/437

[58] Field of Search ..... 49/419, 421, 428, 437, 49/438, 440, 442, 443, 444

[56] References Cited

U.S. PATENT DOCUMENTS 366,524 7/1887 Stone ..... 49/437
2,346,887 4/1944 Winkler ..... 24/618
3,293,802 11/1987 Fletcher ..... 49/438

*Primary Examiner*—Kenneth J. Dorner
*Assistant Examiner*—G. Anderson
*Attorney, Agent, or Firm*—Macdonald J. Wiggins

[57] ABSTRACT

A unitary vent guide for a metal vent frame in a metal window jamb is formed from a resilient and self-lubricating plastic such as nylon and includes a body portion which snaps into a slot in the vertical faces of the vent frame. An outer portion of the body is formed as a tension arm which contacts an inner vertical face of the jamb. A plurality of the guides is installed on each vertical vent frame face and maintains the vent frame centered.

6 Claims, 1 Drawing Sheet

VENT GUIDE

BACKGROUND OF THE INVENTION

1. Field of the Invention

The present invention relates to sliding metal windows and more particularly to a plastic guide for centering a vent sash within the jamb.

2. Brief Description of the Prior Art

In a single hung metal frame window, generally the movable vent is required to have some means for maintaining the vent centered within the hamb since most jambs are not truly square. Also, means must be provided to prevent the sliding vent metal frame from rubbing the frame of the fixed sash. Various devices have been used in the prior art as exemplified by the following U.S. Pat. Nos. 114,253 Bacheller; 174,029 Talbott; 603,783 Denhame; 1,502,644 Campbell; 1,701,548 Snyder; 1,760,227 Appleby; 2,288,077 Fabry; 2,450,078 Booth, Jr.; 2.505,638 Day; 2,781,876 Van Fleet.

None of these disclosures are entirely satisfactory for modern signle hung metal frame windows used in residential construction. There is thus a need for a low cost, effective vent guide which will permit the movable vent to slide easily and without jamming.

SUMMARY OF THE INVENTION

The invention is a one-piece vent guide preferably molded from nylon plastic and includes a body portion adapted to snap into a slot in the face of a vertical metal vent frame and to act as a slidable spacer with respect to the window frame jamb of a single hung window. The vent guide includes a tension arm which extends beyond the lateral edge of the vent frame and contacts the jamb surface. The spacings between frames and jambs are selected to maintain the tension arm under sufficient tension to permit the vent to slide easily within the jambs and to flex as required to compensate for misalignment of the jambs.

A plurality of vent guides may be used along each vertical edge of the vent frames of the window. As may be recognized, the vent guide can be produced at a very low cost, is quickly and easily installed, and will have a long life.

It is therefore a principal object of the invention to provide a low cost unitary vent guide for metal single hung windows for permitting ease of raising and lowering the vent without jamming.

It is another object of the invention to provide a one-piece vent guide molded from a resilient plastic having a tension arm and a spacer portion in which the tension arm maintains alignment of the vent frame and the spacer prevents rubbing of the sash frame.

These and other advantages and objects of the invention will become apparent from the following detailed description when read in conjunction with the drawings.

DETAILED DESCRIPTION OF THE PREFERRED EMBODIMENT

Figure 1:
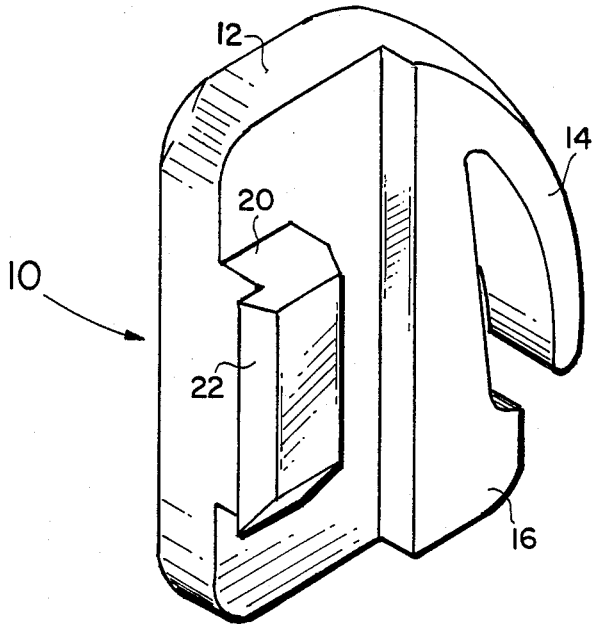
FIG. 1 is a perspective view of the vent guide of the invention.

Referring to FIG. 1, a perspective view of a preferred embodiment of a unitary vent guide 10 of the invention is shown. Although the vent guide 10 may be fabricated in any size dependent upon the size of the vent and vent frame, a typical unit for residential windows may be $\frac{5}{8}$ inches high and $\frac{1}{2}$ inches wide. The material from which vent guide 10 is made is required to be smooth and elastic, such as nylon plastic. Preferably, the surfaces of vent guide 10 are of a self-lubricating nature.

Vent guide 10 includes a body portion 12 having a boss 20 and retainer 22 formed along one vertical edge thereof, and a spacer block 16. A tension arm 14 is formed along the other vertical edge of body portion 12.

Figure 2:
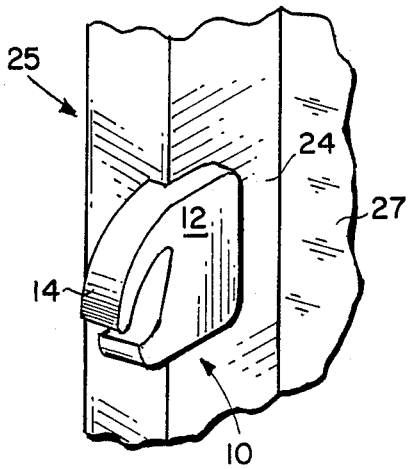
FIG. 2 is a perspective view of the vent guide of FIG. 1 attached to the inner face of a vent frame.
Figure 3:
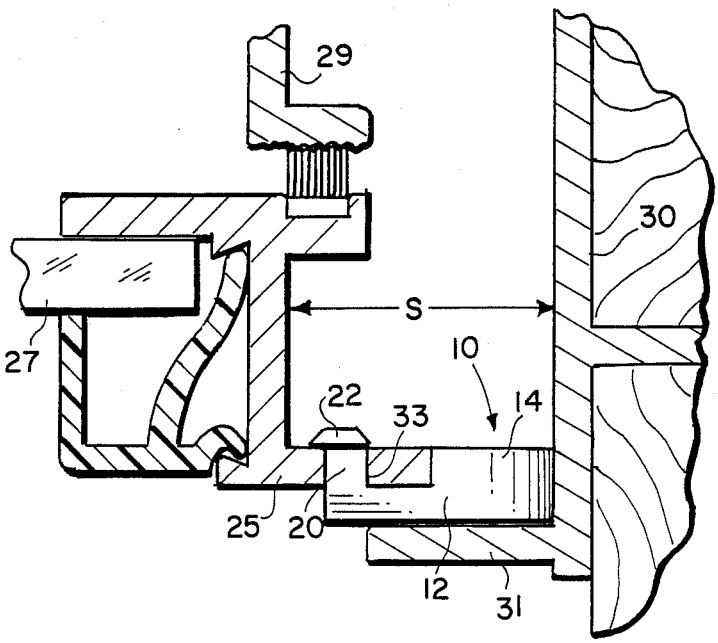
FIG. 3 is a partial cross-sectional view of a typical single hung metal window frame and jamb having the vent guide of FIG. 1 installed.

Vent guide 10 is shown attached to a vertical inner face 24 of a metal vent frame 25 in FIGS. 2 and 3. FIG. 2 is a perspective view of vent guide 10 attached to vent frame 25 and in the cross-sectional view of FIG. 3. A fixed sash frame 29, movable vent frame 25, and pane 27 are shown installed in a jamb 30. Retainer 22 along an outer surface of boss 20 is tapered on three sides thereof and includes an overhanging lip along the outer edge. Due to the resiliency of the material, retainer 22 may be pushed through a slot 33 in face 24 in which slot 33 has the approximate dimensions of boss 20. The overhanging portion of retainer 22 thereby serves to hold vent guide 10 in place.

Body portion 12 serves as a spacer between vent frame face 24 and jamb web 31 of window jamb 30 to prevent metal to metal contact thereby reducing friction therebetween. Due to the self-lubricating properties of the material of vent guide 10 which may be nylow, plastic, or the like, vent frame 25 2ill slide easily as the window is raised and lowered. As will be understood, several vent guides 10 may be attached along the vertical portions of vent frame face 24 on each side of the vent and will bear against the opposing jamb interior faces 35.

Space S between vent frame 25 and jamb face 35 is selected to place tension arm 14 under tension when the vent frame is installed in jamb 30 such that tension arm 14 slides easily along jamb face 35. As is common, the pair of jambs 30 may not be exactly parallel due to variations in framing or due to warping. In such instances, spacing S will not be uniform and tension arm 14 will flex as the window is raised and lowered without jamming as can occur with prior art window construction.

Although the preferred embodiment of the invention has been disclosed, it is to be understood that it is for exemplary purposes only. Various modifications in design may be made without departing from the spirit and scope of the invention.

I claim:

1. In a metal window construction having a rectangular movable metal vent frame within a metal window jamb, said jamb having a pair of opposed vertical interior faces and a pair of vertical webs at right angles to said vertical interior faces, said vent frame having a pair of vertical faces in the plane of said frame and opposing interior faces of said webs, a plurality of unitary vent guides for centering said movable vent frame between said pair of jamb faces and for sliding along said interior faces of said webs, each of said vent guides comprising:

a body portion;

means for attaching said body portion to one of said frame vertical faces to extend between said frame vertical face and an inner face of said vertical web, such that a portion of said body is in sliding contact with one of said vertical webs; and a tension arm projecting from said body in the plane of said frame for contacting one of said vertical jamb faces;

whereby said plurality of said vent guides serves to reduce sliding friction between said jamb web and said frame face, and said tension arms maintain said vent frame centered between said pair of vertical interior jamb faces.

2. The vent guides as recited in claim 1 in which each of said vent guides is formed from nylon.

3. The vent guides as recited in claim 1 in which said attaching means includes:

a vertical slot in said vent frame vertical face; and a boss projecting from said body portion for insertion into said slot.

4. The vent guides as recited in claim 3 in which said boss includes a tapered retaining lip for retaining said vent guide attached to said vent frame.

5. In a window system having a metal window jamb including a pair of opposed vertical interior faces and a pair of vertical webs thereof at right angles to said interior faces, and a movable metal vent frame disposed between said pair of jamb vertical interior faces and including a pair of vertical faces thereof in the plane of said frame, a unitary vent guide comprising:

an essentially rectangular body portion having a pair of parallel faces and formed from a self-lubricating resilient material;

an essentially rectangular boss disposed along one of said vent frame vertical faces and projecting therefrom, said boss having a tapered retaining lip projecting along an outer edge thereof, said retaining lip formed to snap into a slot in one of said vent frame vertical faces to dispose said body portion between said jamb web and said frame face; and a tension arm extending from an edge of said body portion to contact one of said jamb vertical interior faces;

whereby a plurality of said vent guides is attached along each of said vent frame vertical faces, said tension arms being thereby placed under tension between said jamb interior faces to maintain said vent frame centered in said window jamb.

6. In a window construction having vertical jamb portions including vertical interior opposed surfaces and first vertical webs projecting from said interior surfaces, an essentially rectangular metal vent sash having second vertical webs parallel with said first vertical webs, a plurality of spacing and centering vent guides, each of said guides comprising:

a vent guide body disposed between said first and second vertical webs for maintaining a preselected spacing therebetween;

attachment means for attaching said vent guide body to said second vertical web; and a tension arm extending from said guide body and contacting one of said interior surfaces such that a plurality of said tension arms maintain such vent sash centered between said vertical jamb portions.

* * * * *